US005347439A

United States Patent [19]

Warren

[11] Patent Number: 5,347,439

[45] Date of Patent: Sep. 13, 1994

[54] FLASHLIGHT HOLDER

[76] Inventor: James A. Warren, 3706 Amber Ave., Rowlett, Tex. 75088

[21] Appl. No.: 57,518

[22] Filed: May 6, 1993

[51] Int. Cl.[5] ..... F21L 7/00

[52] U.S. Cl. ..... 362/190; 362/95; 362/253; 294/24

[58] Field of Search ..... 362/95, 190, 191, 253, 362/382, 102; 294/19.1, 24; 248/316.7, 205.2, 229, 544; 446/485

[56] References Cited

U.S. PATENT DOCUMENTS

| | | | |
|---|---|---|---|
| 306,188 | 10/1984 | Strong | 294/19.1 |
| 1,718,316 | 6/1929 | Swanson | 362/382 |
| 2,194,831 | 3/1940 | Marshall | 294/19.1 |
| 3,350,787 | 11/1967 | Ramano | 248/544 |
| 3,612,853 | 10/1971 | Aoki | 362/191 |
| 3,843,981 | 10/1974 | Verest | 294/24 |
| 4,001,903 | 1/1977 | Hay | 294/19.1 |
| 4,586,741 | 5/1986 | Muti | 294/19.1 |
| 4,611,264 | 9/1986 | Bradley | 362/95 |
| 4,943,097 | 7/1990 | Sanger | 294/24 |

FOREIGN PATENT DOCUMENTS

| | | | |
|---|---|---|---|
| 298257 | 6/1917 | Fed. Rep. of Germany | 362/191 |
| 138824 | 9/1934 | Fed. Rep. of Germany | 362/190 |
| 771626 | 7/1934 | France | 362/191 |
| 272325 | 3/1930 | Italy | 362/190 |
| 360947 | 7/1938 | Italy | 362/190 |

*Primary Examiner*—Ira S. Lazarus
*Assistant Examiner*—Y. Quach

[57] ABSTRACT

A flashlight holder, particularly adapted to aid small children entering a darkened room, which comprises an elongated base member having a flashlight removeably mounted on one end thereof and means mounted on the other end thereof to engage a conventional vertically operating electrical toggle switch to aid in turning such switch on or off, and to provide a way of storing such holder for easy access to a child.

4 Claims, 4 Drawing Sheets

FLASHLIGHT HOLDER

BACKGROUND OF THE INVENTION

1. Field of the Invention

The present invention relates to flashlight holders and more particularly pertains to such a holder which is especially adapted to the use of small children.

2. Description of the Prior Art

The use of small penlight flashlights is known in the prior art. More specifically, holders heretofore devised and utilized for the purpose of use with such lights are known to consist basically of familiar, expected and obvious structural configurations, usually consisting of a pen type pocket clip affixed hereto notwithstanding the myriad of designs encompassed by the crowded prior art which have been developed for the fulfillment of countless objectives and requirements. Examples of such lights and holders are shown in U.S. Pat. No. 5,070,438 and in U.S. Pat. Nos., Des. 244,796; Des 252,170 and Des. 282,686.

In this respect, the flashlight holder according to the present invention substantially departs from the conventional concepts and designs of the prior art, and in so doing provides an apparatus primarily developed for the purpose of aiding a small child entering a darkened room. In particular, the device of the present invention will aid a small child to turn on or off an otherwise unreachable wall light switch.

Therefore, it can be appreciated that there exists a continuing need for new and improved flashlight holders which can be used by children. In this regard, the present invention substantially fulfills this need.

SUMMARY OF THE INVENTION

In view of the foregoing disadvantages inherent in the known types of flashlight holders now present in the prior art, the present invention provides an improved flashlight holder construction wherein the same can be utilized to help quell any fears a small child may have in moving about in the dark. As such, the general purpose of the present invention, which will be described subsequently in greater detail, is to provide a new and improved flashlight holder which has all the advantages of the prior art devices and none of the disadvantages.

To attain this, the present invention essentially comprises: a flashlight holder, particularly adapted to aid small children entering a darkened room, which comprises an elongated base member having a flashlight removeably mounted on one end thereof and means mounted on the other end thereof to engage a conventional vertically operating electrical toggle switch to aid in turning such switch on or off, and to provide a way of storing such holder for easy access to a child.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved flashlight holder which has all the advantages of the prior art devices and none of the disadvantages.

It is another object of the present invention to provide a new and improved flashlight holder which may be easily and efficiently manufactured and marketed.

It is a further object of the present invention to provide a new and improved flashlight holder which is of a durable and reliable construction.

An even further object of the present invention is to provide a new and improved flashlight holder which is susceptible of a low cost of manufacture with regard to both materials and labor, and which accordingly is then susceptible of low prices of sale to the consuming public, thereby making such devices economically available to the buying public.

Still yet another object of the present invention is to provide a new and improved flashlight holder which provides in the apparatuses and methods of the prior art some of the advantages thereof, while simultaneously overcoming some of the disadvantages normally associated therewith.

Still another object of the present invention is to provide a new and improved flashlight holder especially adapted for small children.

Yet another object of the present invention is to provide a new and improved flashlight holder which will aid a child in turning on or off conventional electrical wall switches positioned out of his normal reach.

Even still another object of the present invention is to provide a new and improved flashlight holder which is readily accessible to a child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
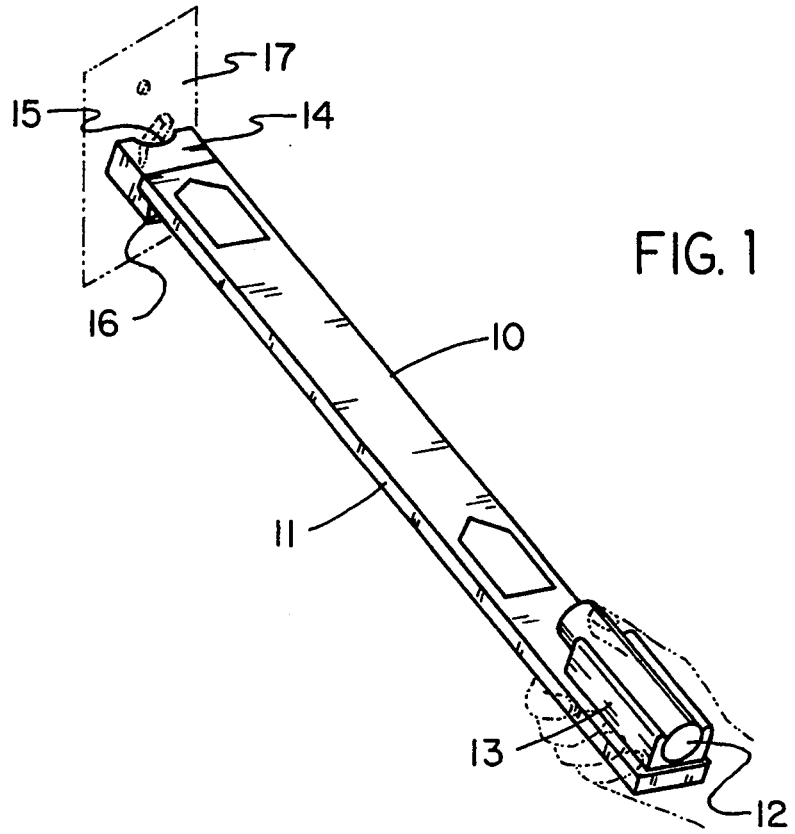
FIG. 1 is a perspective view of the present invention as applied in conjunction with an electrical wall switch.

With reference now to the drawings, and in particular to FIG. 1 thereof, a new and improved flashlight holder embodying the principles and concepts of the present invention and generally designated by the reference numeral 10 will be described.

The flashlight holder 10 consists of an elongated rigid base member 11 formed of plastic, wood or the like. Affixed removeably to one end thereof is a penlight type flashlight 12 having its illumination directed along such member 11 towards the other end thereof. A clip type holder 13 is affixed to the surface of member 11 by adhesion, mechanical fasteners such as screws or bolts or in any other suitable manner. Flashlight 12 seats within holder 13 which preferably is formed of a springable material such as plastic or metal so as to engage with and hold flashlight 12 but which can be sprung to release the light if desired. The opposite end of elongated member 11 constitutes or has mounted thereon a wall switch engaging means 14. In it preferred form this means 14 is formed of an elastomeric material such as hard rubber or the like, sufficiently soft as to minimize injury if one is hit thereby yet rigid enough to substantially sustain its shape when pressure is applied thereto. Such means 14 is formed with an arcuate recess 15 at the outer end thereof and an angular projection 16 on the base thereof, such projection 16 being angled back towards the flashlight end of member 11. In use, means 14 will permit a small child to turn on or off a conventional wall-mounted electrical toggle switch (such as shown in broken lines at 17) by manipulating member 11 to reach the wall switch 17 (normally designed for adult use and out of arms reach of a small child). The arcuate recess 15 will engage with such a wall switch in the down position and by pushing on member 11 will move such switch 17 into its upper or "on" position. Flashlight 12 will permit the child to locate such switch 17. When leaving the room, the child again may utilize holder 10 to reach the switch 17 in its upper position and, by engaging projection 16 over the wall switch and pulling downwardly on member 11, to throw such switch 17 into its "off" position. Obviously, means 14 may be an integral part of member 11 if desired with the arcuate recess 15 and projection 16 formed therein.

Figure 2:
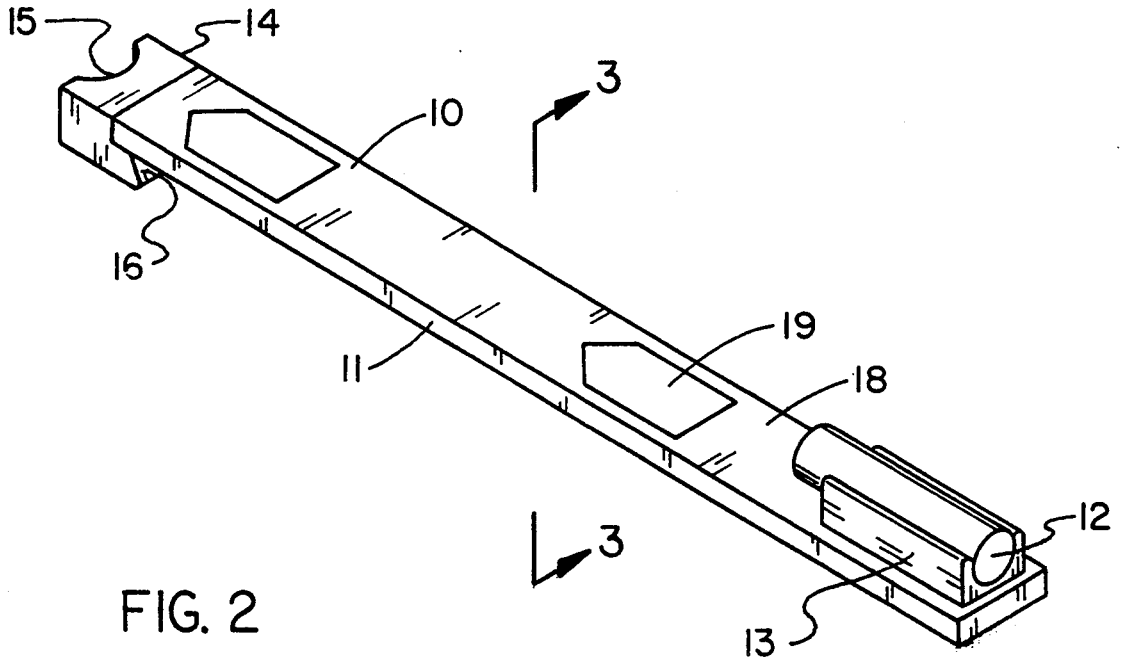
FIG. 2 is a perspective view of the device of the present invention.
Figure 3:
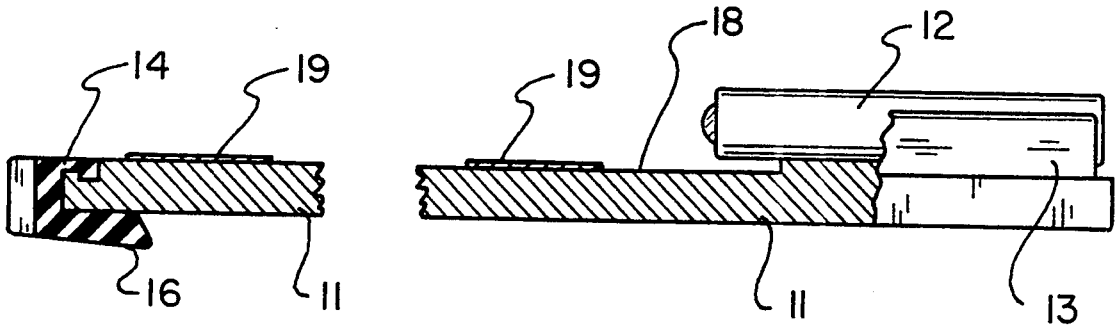
FIG. 3 is a partial sectional side view on line 3—3 of FIG. 2.

FIG. 2 shows holder 10 in more detail, particularly with regard means 14. As indicated in this view, the member 11 has a flat or substantially flat upper surface 18 to which may be affixed such indicia 19 as desired, e.g. lined as for a ruler, company logos, advertising messages, etc. In the partial sectional view of FIG. 3, the darker shading of projections 16 indicates the use of the elastomeric material referred to above.

Figure 4:
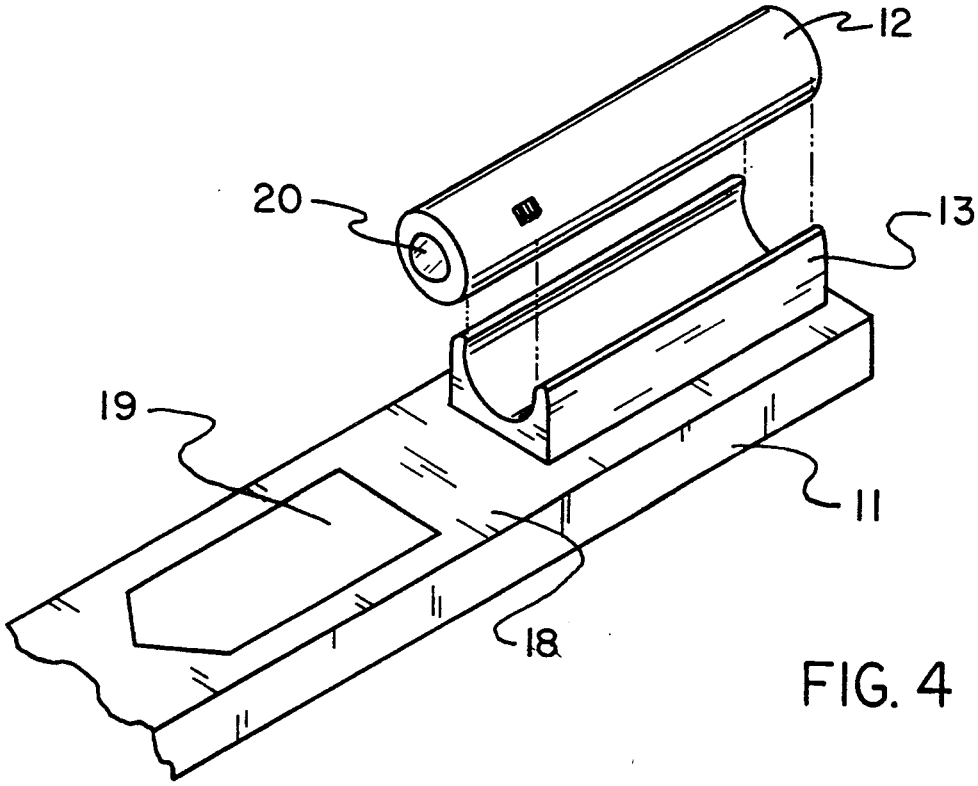
FIG. 4 is a partially exploded perspective view of one end of the device of the present invention.

FIG. 4 shows in more detail the removable positioning of the penlight type flashlight 12 in its holder 13. As discussed in connection with the description of FIG. 1 such light 12 throws its light from bulb 20 towards the remote end of member 11.

Figure 5:
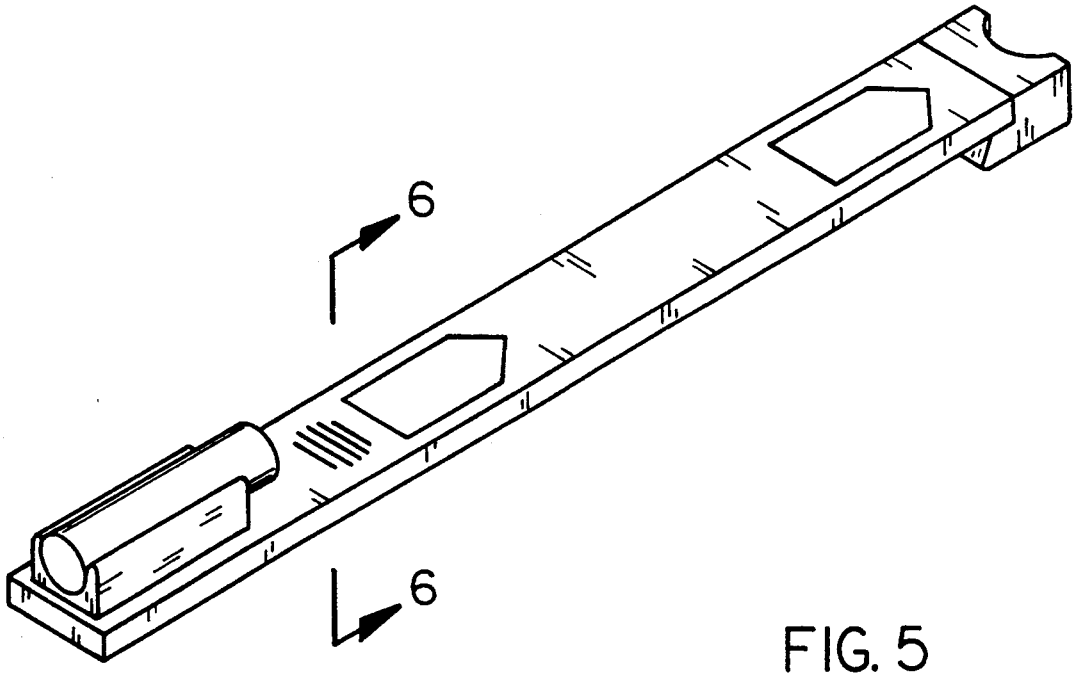
FIG. 5 is a perspective view of one modification of the present invention.
Figure 6:
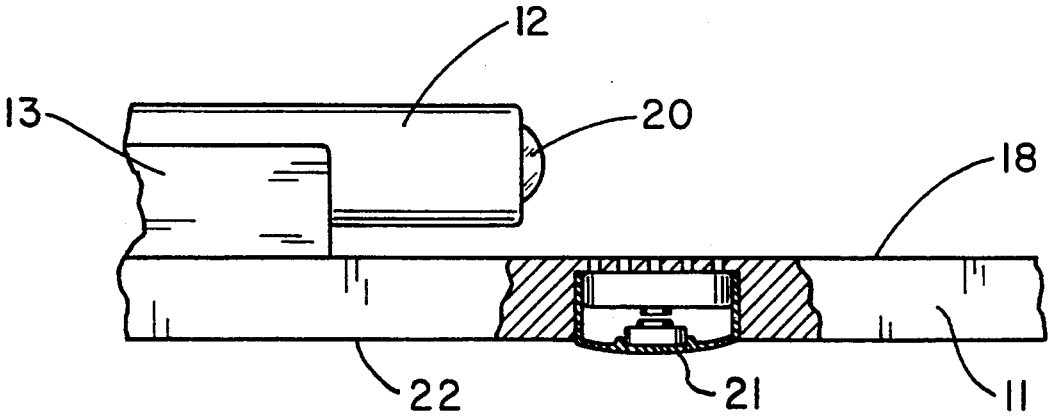
FIG. 6 is a partial sectional view taken on line 6—6 of FIG. 5.
Figure 7:
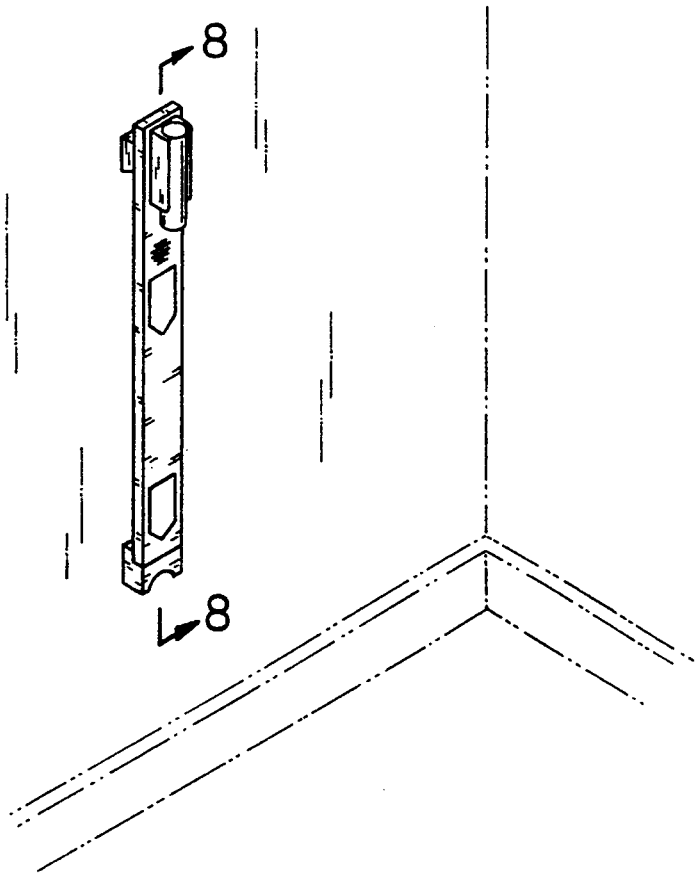
FIG. 7 is a perspective view of the device of the present invention showing one manner of wall-mounting the same.
Figure 8:
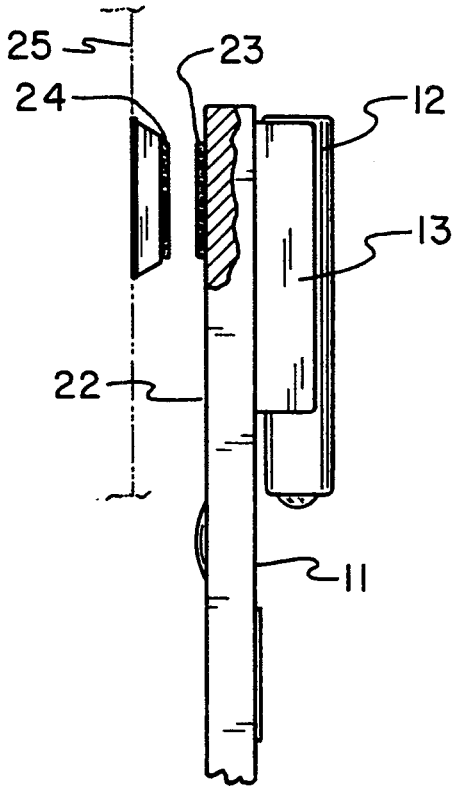
FIG. 8 is a sectional view taken on line 8—8 of FIG. 7.

FIG. 5 and 6 illustrate that an additional music or amusement device 21 may be inserted into the lower surface 22 of member 11 if desired.

While the holder 10 may be stored when not in use by engaging the projection 16 over a suitable ledge such as a wainscoting molding or window ledge, it may be more convenient to store the holder 10 by providing the lower surface 22 with a hook and loop type flat fastener 23 adapted to engage with a mating surface 24 affixed to a room wall indicated at 25 in broken lines.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved flashlight holder which comprises: an elongated base member; said elongated base member having first and second opposed ends orthogonally related to a longitudinal axis defined by said elongated base member, said base member further having upper and lower opposed sides extending in the direction of said axis between said opposed ends thereof; means proximal to said first end of said base member to removeably affix a flashlight to said upper side thereof; and means on said second end of said base member to operatively engage a vertically-mounted electrical toggle switch;, wherein said means to operatively engage said switch comprises an arcuate recess in said second end of said base member and a depending projection on said lower side of said base member, said depending projection having a first edge proximal to said arcuate recess, said depending projection having a second distal edge extending angularly rearwardly toward said first end of said base member transversely of said base member.

2. A flashlight holder as in claim 1 wherein said depending projection extends angularly back toward said first end of said base member with respect to said lower side thereof.

3. A flashlight holder as in claim 2 wherein said depending projection is formed of a resilient material.

4. A flashlight holder as in claim 3 wherein means attached to said base member to removeably affix said elongated base member to a wall for storage.

* * * * *